US012345260B2

(12) United States Patent
Lee et al.

(10) Patent No.: US 12,345,260 B2
(45) Date of Patent: Jul. 1, 2025

(54) FLUID CIRCULATING APPARATUS

(71) Applicant: COAVIS, Sejong-si (KR)

(72) Inventors: Hyun Tae Lee, Sejong-si (KR); Woo Keun Lee, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 18/749,956

(22) Filed: Jun. 21, 2024

(65) Prior Publication Data

US 2024/0426295 A1 Dec. 26, 2024

(30) Foreign Application Priority Data

Jun. 22, 2023 (KR) ..... 10-2023-0080644

(51) Int. Cl.
*F04C 2/16* (2006.01)
*F04C 11/00* (2006.01)
*F04C 15/06* (2006.01)

(52) U.S. Cl.
CPC ..... *F04C 2/165* (2013.01); *F04C 11/001* (2013.01); *F04C 11/008* (2013.01); *F04C 15/064* (2013.01); *F04C 2240/40* (2013.01)

(58) Field of Classification Search
CPC F04C 2/16; F04C 2/165; F04C 11/001; F04C 11/008; F04C 29/04; F04C 2240/40; F04C 15/164; F04C 29/124; F01P 11/029; F01P 5/10–12
See application file for complete search history.

(56) References Cited

U.S. PATENT DOCUMENTS

| | | | | |
|---|---|---|---|---|
| 9,188,128 | B2 | 11/2015 | Lee et al. | |
| 10,665,908 | B2 | 5/2020 | Krull et al. | |
| 2013/0136628 | A1 | 5/2013 | Lee et al. | |
| 2017/0373359 | A1* | 12/2017 | Krull | B60K 11/02 |
| 2022/0325657 | A1* | 10/2022 | Jeong | F01P 5/10 |
| 2022/0403770 | A1* | 12/2022 | Kim | F01P 5/10 |
| 2024/0052837 | A1* | 2/2024 | Lee | F04C 15/06 |
| 2024/0263576 | A1* | 8/2024 | Lee | F04C 2/165 |

FOREIGN PATENT DOCUMENTS

| | | | |
|---|---|---|---|
| CN | 218021197 | U | 12/2022 |
| KR | 10-1305671 | B1 | 9/2013 |
| KR | 10-20190019178 | A | 2/2019 |

OTHER PUBLICATIONS

CN218021197U—Lee et al.—Cooling Module—Dec. 13, 2024—the English Machine Translation. (Year: 2022).*

* cited by examiner

*Primary Examiner* — Theresa Trieu
(74) *Attorney, Agent, or Firm* — DICKINSON WRIGHT PLLC

(57) ABSTRACT

Disclosed is a fluid circulating apparatus in which a reservoir, a valve part, and a pump part are integrated with one another, and the valve part and the pump part are disposed in the reservoir to thus achieve a compact structure, thereby achieving a reduced overall size and stabilizing a fluid circulation when pumping a fluid through a plurality of flow paths.

7 Claims, 6 Drawing Sheets

FLUID CIRCULATING APPARATUS

CROSS-REFERENCE TO RELATED APPLICATIONS

This application claims priority under 35 U.S.C. § 119 to Korean Patent Application No. 10-2023-0080644, filed on Jun. 22, 2023, in the Korean Intellectual Property Office, the disclosure of which is incorporated herein by reference in its entirety.

TECHNICAL FIELD

The following disclosure relates to a fluid circulating apparatus in which a reservoir, a valve, and a water pump are integrated into a compact structure, and a fluid is circulated selectively through a plurality of flow paths.

BACKGROUND

A mobility may include a water pump cooling each part by circulating a cooling medium to a part required to be cooled.

The water pump applied to a conventional vehicle may always be operated to circulate a coolant regardless of a temperature condition of an engine when the engine is operated. Accordingly, a discharge flow rate of the water pump may be linearly increased in proportion to revolutions per minute (RPM) of the engine, and the engine may be supercooled during its warm-up stage to have a delayed warm-up speed.

That is, the discharge flow rate of the water pump may be set to the maximum output (or a high speed/high load) condition to prevent engine overheating and protect a cooling system component. Therefore, the discharge flow rate may be linearly increased even under a low load condition for the engine to have a delayed temperature increase time in the warm-up stage, thus causing its unnecessary cooling.

Accordingly, an electric water pump operated by a motor may be used. The electric water pump may compress and pump the cooling medium to increase a circulation amount of the cooling medium.

In addition, various parts such as a reservoir and a valve as well as the water pump may be disposed in a cooling medium circulating line. As the respective parts are installed separately, a space occupied by each part may be increased, which is disadvantageous to an overall package.

The contents described as the related art are provided only to assist in understanding the background of the present disclosure, and should not be considered as corresponding to the related art known to those skilled in the art.

RELATED ART DOCUMENT

Patent Document (Patent Document 1) KR 10-1305671 B1 (Sep. 2, 2013)

SUMMARY

An embodiment of the present disclosure is directed to providing a fluid circulating apparatus in which a reservoir, a valve, and a water pump are integrated into a compact structure, and a fluid is circulated selectively through a plurality of flow paths.

In one general aspect, a fluid circulating apparatus includes: a reservoir housing having an internal space for storing a fluid and including a plurality of ports; a valve part communicating with the internal space of the reservoir housing and some ports, and allowing the fluid in the internal space to be circulated selectively to some or all of the ports; and a pump part disposed in the reservoir housing to be connected to the valve part, and pumping the fluid passed through the valve part.

The ports of the reservoir housing may include a first port, a second port, and a third port, the first port may be disposed on an upper side of the reservoir housing, the second port may be disposed on a lower side of the reservoir housing, and the third port may be open upward from the top of the reservoir housing.

The valve part may include a valve housing, a valve, and an actuator, the valve housing may include a first passage opened to the internal space, a second passage opened to the second port, and a third passage opened to the third port, and a rotation position of the valve may be determined based on whether the actuator is operated, and each passage may thus be opened and closed selectively.

The valve housing may be disposed on a bottom surface of the reservoir housing, and have a portion passing through the bottom surface of the reservoir housing and exposed to the outside, thus allowing the valve to be disposed in the internal space, and the actuator to be disposed outside the reservoir housing.

The valve may include a plurality of first through holes disposed in an outer surface and matching the first passage or the second passage based on the rotation position of the valve, and a second through hole disposed in an upper surface and constantly communicating with the third passage.

Each first through hole of the valve may extend by a certain length along an outer peripheral surface of the valve.

The pump part may be disposed above the valve housing, and communicate with the third port of the reservoir housing and the third passage of the valve housing.

The pump part may include a pump housing, a screw part, and a motor, the pump housing may be installed in the reservoir housing, and communicate with the third port of the reservoir housing and the third passage of the valve housing, the screw part and the motor may be disposed in the pump housing, and the screw part may pump the fluid by rotating the motor.

The screw part may include a screw housing, and a main screw, an auxiliary screw and a thrust key, disposed in the screw housing, the main screw may be rotated by being connected to the motor, the auxiliary screw may be rotated by being engaged with the main screw, and the main screw and the auxiliary screw may be rotatably connected to each other by a medium of the thrust key.

An additional pump part may further be disposed in the reservoir housing, and connected to the second port.

In another general aspect, a fluid circulating apparatus includes: a reservoir housing having an internal space for storing a fluid and including an inlet port and a plurality of outlet ports; a valve part disposed in the reservoir housing to communicate with the internal space of the reservoir housing and the plurality of outlet ports, and allowing a fluid in the internal space to be circulated selectively to any one or all of the outlet ports; and a plurality of pump parts connected to each of the outlet ports of the reservoir housing by a medium of the valve part and pumping the fluid passed through the valve part.

One of the plurality of pump parts may be disposed in the reservoir housing and above the valve part to be connected to the outlet port, and the other pump part may be disposed outside the reservoir housing to be connected to the outlet port.

A mounting part, on which the external pump part is mounted, may be disposed outside the reservoir housing, thus allowing the pump part disposed outside the reservoir housing to be connected to the outlet port while mounted on the mounting part.

Other features and aspects will be apparent from the following detailed description, the drawings, and the claims.

DETAILED DESCRIPTION OF EMBODIMENTS

Figure 1:
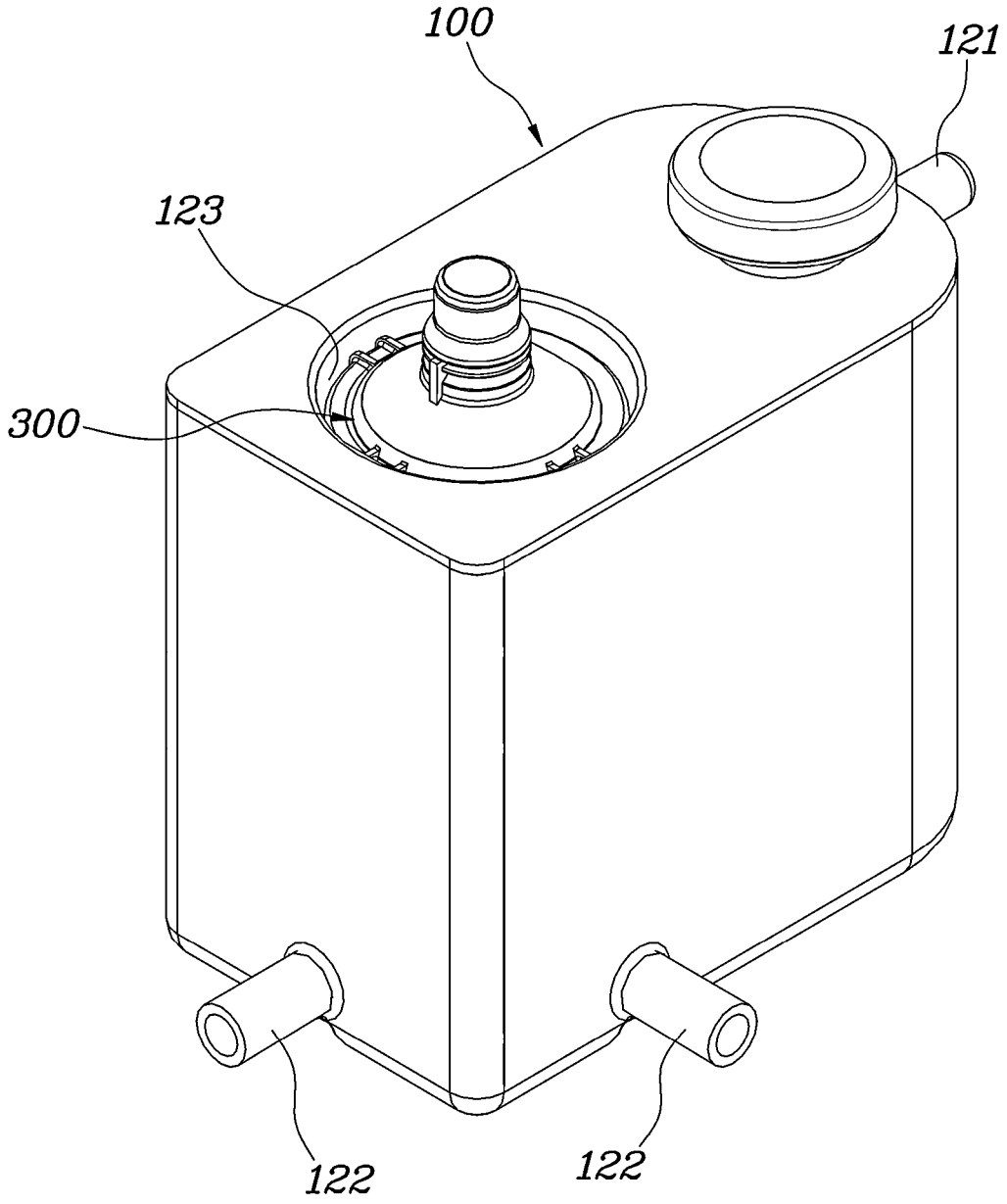
FIG. 1 is a diagram showing a fluid circulating apparatus according to an embodiment of the present disclosure.

Hereinafter, an embodiment of the present disclosure is described in detail with reference to the accompanying drawings. The same or similar components are denoted by the same reference numerals independent of the drawing numerals, and an overlapping description for the same or similar components are omitted.

In addition, terms "module" and "unit" for components used in the following description are given only in consideration of ease in the preparation of the present disclosure. Therefore, these terms do not have meanings or roles that distinguish themselves from each other.

Further, when it is determined that a detailed description for the known art related to the present disclosure may obscure the gist of the present disclosure, the detailed description will be omitted. Furthermore, it is to be understood that the accompanying drawings are provided only to allow the embodiments of the present disclosure to be easily understood, and the spirit of the present disclosure is not limited by the accompanying drawings and includes all the modifications, equivalents and substitutions included in the spirit and scope of the present disclosure.

Terms including ordinal numbers such as "first", "second", and the like, may be used to describe various components. However, these components are not limited by these terms. The terms are used only to distinguish one component from another component.

It is to be understood that if one component is referred to as being "connected to" or "coupled to" another component, one component may be directly connected to or directly coupled to another component, or may be connected to or coupled to another component while having a third component interposed therebetween. On the other hand, it is to be understood that when one component is referred to as being "directly connected to" or "directly coupled to" another component, it may be connected or coupled to another component without a third component interposed therebetween.

A term of a single number may include its plural number unless explicitly indicated otherwise in the context.

It is to be understood that terms such as "include", "have", and the like used in this application, specify the presence of features, numerals, steps, operations, components, parts, or combinations thereof, mentioned in the specification, and do not preclude the presence or addition of one or more other features, numerals, steps, operations, components, parts, or combinations thereof.

A controller may include a communication device that communicates with other controllers or sensors to control a function in charge, an operating system, a memory that stores logic instructions, input/output information, or the like, or one or more processors that perform determinations, calculations, decisions, or the like, necessary to control the functions in charge.

Hereinafter, a fluid circulating apparatus according to embodiments of the present disclosure is described with reference to the accompanying drawings.

Figure 2:
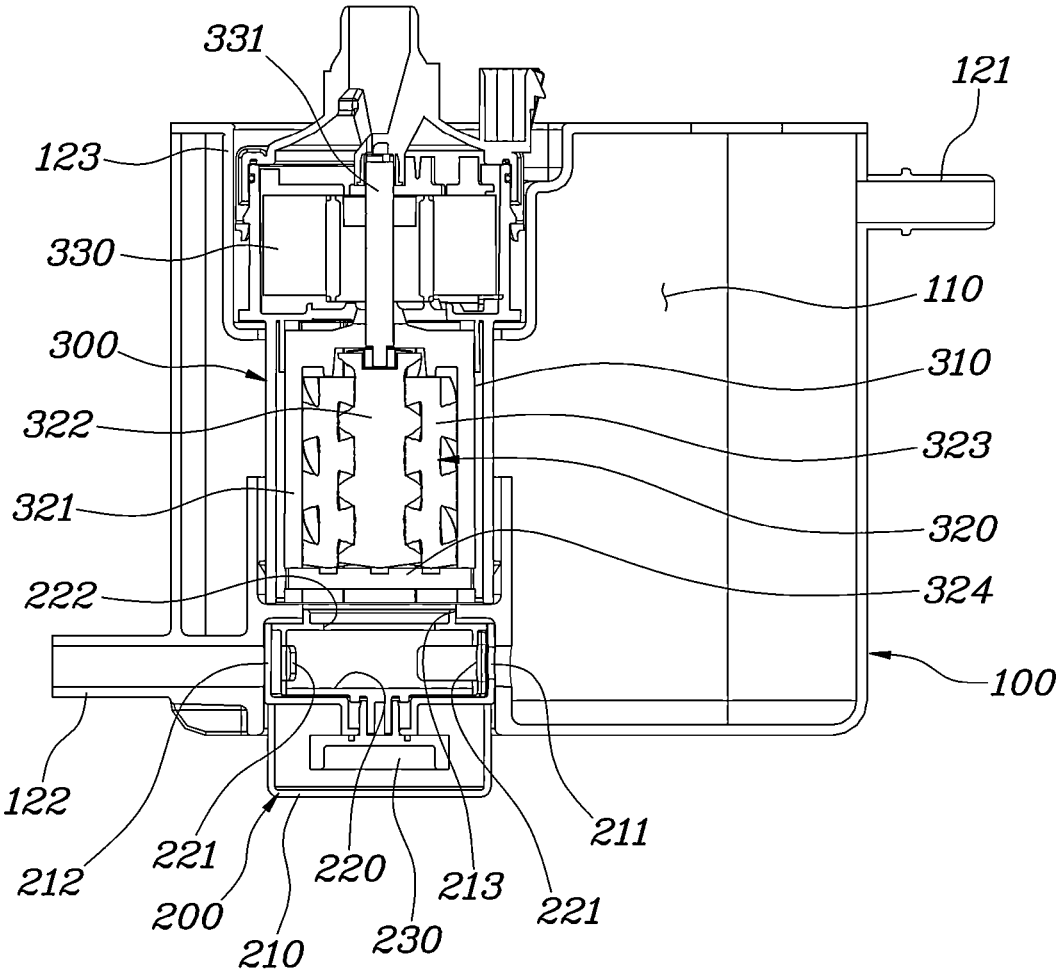
FIG. 2 is a cross-sectional view of the fluid circulating apparatus shown in FIG. 1.
Figure 3:
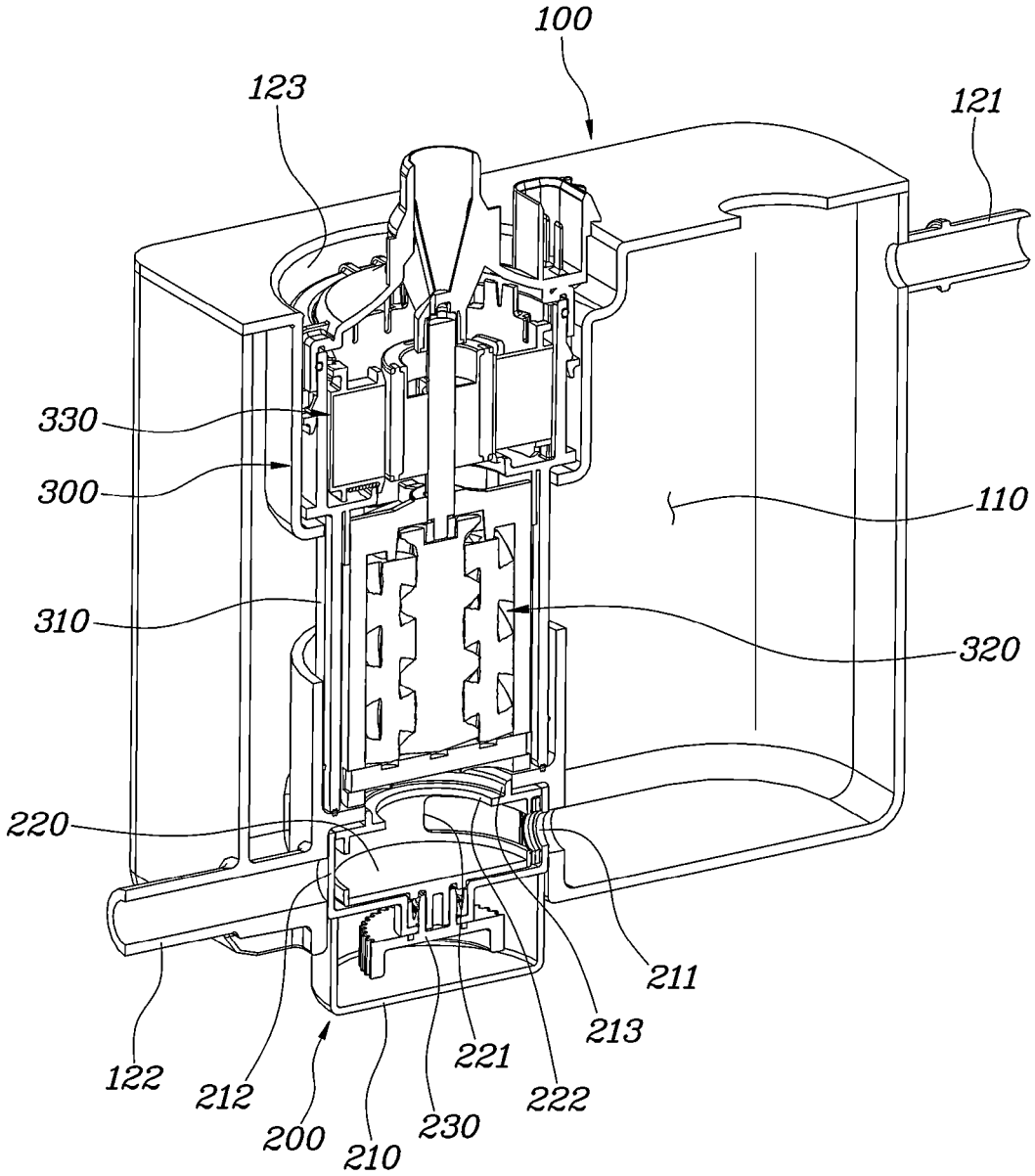
FIG. 3 is a diagram showing the inside of the fluid circulating apparatus shown in FIG. 1.

As shown in FIGS. 1 to 3, a fluid circulating apparatus according to the present disclosure may include: a reservoir housing 100 having an internal space 110 for storing a fluid and including a plurality of ports; a valve part 200 communicating with the internal space 110 of the reservoir housing 100 and some ports, and allowing the fluid in the internal space 110 to be circulated selectively to some or all of the ports; and a pump part 300 disposed in the reservoir housing 100 to be connected to the valve part 200, and pumping the fluid passed through the valve part 200.

The reservoir housing 100 may have the internal space 110, and store the fluid therein. The fluid may be a coolant. The plurality of ports may be disposed on the reservoir housing 100 for the fluid to flow into the internal space 110 or flow out to the outside through each port.

In particular, in the present disclosure, the valve part 200 and the pump part 300 may be built in the internal space 110 of the reservoir housing 100. The valve part 200 and the pump part 300 may be controlled by the controller.

Accordingly, the internal space 110 of the reservoir housing 100 may be divided into a fluid storage space where the fluid is stored and an installation space where the valve part 200 and the pump part 300 are disposed. The fluid in the fluid storage space may pass through the installation space by the medium of the valve part 200 and the pump part 300 to thus flow out to the outside through each port.

The valve part 200 may be disposed in the internal space 110 of the reservoir housing 100, and communicate with some ports. The valve part 200 may be installed to be adjacent to a port through which the fluid flows to the outside, and control a fluid circulation direction for the fluid in the internal space 110 to selectively flow out through some or all of the ports.

In addition, the pump part 300 may be disposed in the internal space 110 of the reservoir housing 100, and connected to the valve part 200. The pump part 300 may pump the fluid during its operation, and communicate with the valve part 200 through a specific port. As a result, the fluid passed through the valve part 200 may be pumped by the pump part 300, and thus be circulated to other parts.

In this way, the fluid circulating apparatus in the present disclosure may have a compact structure as the valve part 200 and the pump part 300 are built in the reservoir housing 100 to thus reduce its overall size, and the reservoir housing 100, the valve part 200, and the pump part 300 are integrated with one another.

To describe the present disclosure described above in detail, as shown in FIG. 2, the ports of the reservoir housing 100 may include a first port 121, a second port 122, and a third port 123, the first port 121 may be disposed on an upper side of the reservoir housing 100, the second port 122 may be disposed on a lower side of the reservoir housing 100, and the third port 123 may be open upward from the top of the reservoir housing 100.

The reservoir housing 100 may include the plurality of ports for the inflow and outflow of the fluid. According to an embodiment of the present disclosure, the plurality of ports may include the first port 121, the second port 122, and the third port 123. The first port 121 may be a passage through which the fluid flows into the internal space 110, and disposed on the upper side of the reservoir housing 100, and the second port 122 may be a passage through which the fluid flows out of the internal space 110, and disposed on the lower side of the reservoir housing 100. Here, the plurality of second port 122 may be provided depending on a part required to be cooled.

The third port 123 may be a passage through which the fluid flows out of the internal space 110, and open upward from the top of the reservoir housing 100. The pump part 300 may be connected to the third port 123, thus allowing the fluid in the internal space 110 to be pumped by the pump part 300 and flow out upward from the reservoir housing 100. In addition, the third port 123 may be open upward from the top of the reservoir housing 100, and the pump part 300 may thus be installed to be erected. Accordingly, the fluid may be stored in the internal space 110 of the reservoir housing 100 excluding the pump part 300.

The positions of the first port 121, the second port 122, and the third port 123 may be changed in the reservoir housing 100. However, the first port 121 may be disposed on the upper side of the reservoir housing 100, thus allowing the fluid flowing into the internal space 110 to fill the internal space 110 below by gravity, and the second port 122 may be disposed on the lower side of the reservoir housing 100, thus allowing the fluid filling the internal space 110 to flow out stably.

Meanwhile, the valve part 200 in the present disclosure may include a valve housing 210, a valve 220, and an actuator 230. The valve housing 210 may include a first passage 211 opened to the internal space 110, a second passage 212 opened to the second port 122, and a third passage 213 opened to the third port 123. Here, a rotation position of the valve 220 may be determined based on whether the actuator 230 is operated, and each passage may thus be opened and closed selectively.

As shown in FIGS. 2 and 3, the valve housing 210 may be disposed in the internal space 110 of the reservoir housing 100, and the valve 220 and the actuator 230 may be disposed therein. The valve housing 210 may be connected to the second port 122 disposed on the lower side of the reservoir housing 100, and include the first passage 211 opened to the internal space 110, the second passage 212 opened to the second port 122, and the third passage 213 opened to the third port 123 by the medium of the pump part 300.

The valve 220 may be built in the valve housing 210 and have a rotation position changed based on the operation of the actuator 230, and the valve 220 may selectively open and close the first passage 211 and the second passage 212. As a result, the fluid stored in the internal space 110 may be circulated to the second port 122 or the third port 123.

In detail, the valve 220 may include a plurality of first through holes 221 disposed in an outer surface and matching the first passage 211 or the second passage 212 based on the rotation position of the valve 220, and a second through hole 222 disposed in an upper surface and constantly communicating with the third passage 213.

That is, the valve 220 may have a cylindrical shape, and include the plurality of first through holes 221 disposed in the outer surface while being spaced apart from each other, and the second through hole 222 formed as the upper surface is opened. Here, the first through hole 221 may match the first passage 211 or second passage 212 of the valve housing 210 based on the rotation position of the valve 220. As a result, when the first through hole 221 matches the first passage 211, the fluid stored in the reservoir housing 100 may be circulated into the valve 220, and when the first through hole 221 matches the second passage 212, the fluid circulated in the valve 220 may flow out through the second port 122. In addition, the second through hole 222 may be in constant communication with the third passage 213 of the valve housing 210, and the fluid may thus be constantly circulated regardless of the rotation position of the valve 220. That is, the pump part 300 may be disposed above the valve part 200, and the second through hole 222 of the valve 220 may be in constant communication with the third passage 213 of the valve housing 210, thus allowing the fluid to be pumped by the pump part 300 in a direction opposite to a gravity direction.

Here, each first through hole 221 of the valve 220 may extend by a certain length along an outer peripheral surface of the valve 220.

The plurality of first through holes 221 in the valve 220 may be provided to selectively open and close the first passage 211 and second passage 212 of the valve housing 210.

For example, among the first through holes 221, the first through hole 221 matching the second passage 212 may extend by the certain length along the outer peripheral surface, thus preventing a fluid flow problem caused by a rapid movement of the fluid that occurs due to an instantaneous opening or closing operation of the valve 220 when the valve 220 is rotated and the first through hole 221 thus matches the second passage 212. Accordingly, the first through hole 221 matching the second passage 212 may have a width gradually decreased from its center to both ends, and extend only to an extent of opening or closing the second passage 212 based on the rotation position of the valve 220.

The first through hole 221 matching the first passage 211 may be constantly open regardless of the rotation position of the valve 220. Accordingly, the first through hole 221 matching the first passage 211 may extend along the outer peripheral surface to remain matched to the first passage 211 even when the valve 220 is rotated. In this way, the first through hole 221 matching the first passage 211 may be constantly open even when the valve 200 is rotated, thereby maintaining the pumping of the fluid by the pump part 300, and preventing failure of the pump part 300 that occurs due to a fluid blockage.

The third passage 213 of the valve housing 210 and the third port 123 of the reservoir housing 100 may be connected to a part requiring a constant fluid circulation, and constantly provide the fluid to the corresponding part.

Meanwhile, the valve housing 210 may be disposed on a bottom surface of the reservoir housing 100, and have a portion passing through the bottom surface of the reservoir housing 100 and exposed to the outside, thus allowing the valve 220 to be disposed in the internal space 110, and the actuator 230 to be disposed outside the reservoir housing 100.

That is, the valve part 200 may be disposed on the bottom surface in the internal space 110 of the reservoir housing 100 to be connected to the second port 122, and disposed below the pump part 300 to be connected to the third port 123 by the medium of the pump part 300.

In particular, the valve housing 210 may have a portion passing through the bottom surface of the reservoir housing 100 and exposed to the outside to thus reduce a space for installation of the valve part 200 as the valve part 200 is disposed in the internal space 110 of the reservoir housing 100, thereby reducing a size of the reservoir housing 100. That is, the actuator 230 may be disposed below the valve 220 in the valve housing 210. Accordingly, the valve 220 may be disposed in the internal space 110, and the actuator 230 may be exposed outside the reservoir housing 100. Accordingly, the valve part 200 may change the fluid circulation direction by adjusting the position of the valve 220, and a space for installation of the actuator 230 may be deleted as the actuator 230 is disposed in the internal space 110 of the reservoir housing 100, thereby reducing the size of the reservoir housing 100. In addition, management convenience may be improved when assembling or replacing the valve part 200 because the valve part 200 exposed at the bottom of the reservoir housing 100 may be easily assembled or removed.

Meanwhile, the pump part 300 may be disposed above the valve housing 210, and communicate with the third port 123 of the reservoir housing 100 and the third passage 213 of the valve housing 210.

In the present disclosure, the pump part 300 may be disposed in the reservoir housing 100 to be connected to the third port 123, and disposed above the valve part 200 to communicate with the third passage 213 of the valve housing 210. Accordingly, the fluid passed through the valve part 200 may be pumped by the pump part 300 and flow out to the outside through the third port 123.

That is, the third port 123 of the reservoir housing 100 and the third passage 213 of the valve housing 210 may match each other in a vertical direction, and the fluid stored in the reservoir housing 100 may be pumped and circulated by the pump part 300.

In detail, the pump part 300 may include a pump housing 310, a screw part 320, and a motor 330. The pump housing 310 may be installed in the reservoir housing 100, and communicate with the third port 123 of the reservoir housing 100 and the third passage 213 of the valve housing 210. The screw part 320 and the motor 330 may be disposed in the pump housing 310, and the screw part 320 may pump the fluid by rotating the motor 330.

Figure 4:
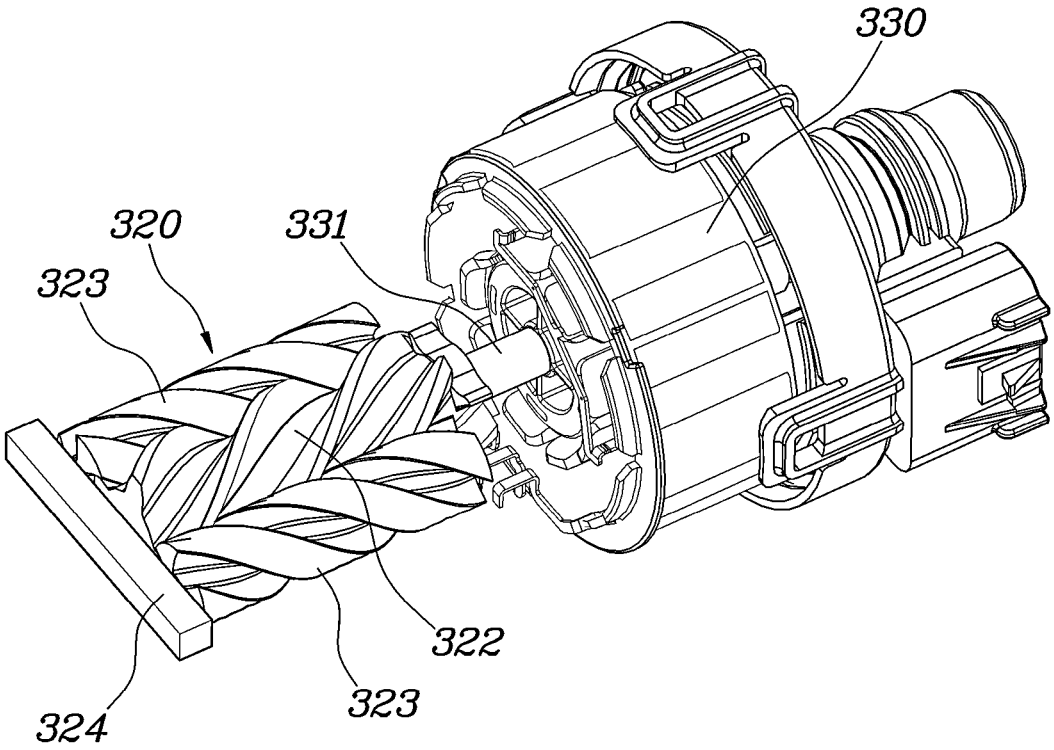
FIG. 4 is a diagram showing a pump part of the fluid circulating apparatus shown in FIG. 1.

As shown in FIGS. 2 to 4, the pump housing 310 may be fixed to the reservoir housing 100, and allow the third port 123 of the reservoir housing 100 and the third passage 213 of the valve housing 210 to communicate with each other. The screw part 320 and the motor 330 may be disposed in the pump housing 310, and the screw part 320 may be connected to the motor 330 to be rotated when the motor 330 is operated, thereby pumping the fluid.

In detail, the screw part 320 may include a screw housing 321, and a main screw 322, an auxiliary screw 323 and a thrust key 324, disposed in the screw housing 321, the main screw 322 may be rotated by being connected to the motor 330, the auxiliary screw 323 may be rotated by being engaged with the main screw 322, and the main screw 322 and the auxiliary screw 323 may be rotatably connected to each other by the medium of the thrust key 324.

The main screw 322 may have a spiral-shaped protrusion protruding along its outer peripheral surface. The main screw 322 may be rotated by being connected to a drive shaft 331 of the motor 330 and receiving a rotational force of the motor 330.

The auxiliary screw 323 may have a spiral groove concave along its outer peripheral surface, and the spiral groove may correspond to the spiral protrusion of the main screw 322. Accordingly, the auxiliary screw 323 may be engaged with the main screw 322 to be rotated together.

The thrust key 324 may extend in the form of a bar, and cross the main screw 322 and the auxiliary screw 323. Accordingly, ends of the main screw 322 and the auxiliary screw 323 may be rotatably connected to each other and supported by the thrust key 324, thus allowing the main screw 322 and the auxiliary screw 323 to be rotated stably. The thrust key 324 may have a small cross-sectional area in consideration of the fluid flow, and have a curved outer surface for a smooth fluid flow.

Accordingly, in the pump part 300, the main screw 322 and the auxiliary screw 323, included in the screw part 320, may be rotated when the motor 330 is operated, and the rotation of the main screw 322 and the auxiliary screw 323 may allow the fluid flowing in through the third passage 213 of the valve housing 210 to be pumped and discharged through the third port 123. In the present disclosure, the motor 330 may allow the fluid to be circulated therein. That is, the drive shaft 331 of the motor 330 may be connected to a rotor by the medium of a plurality of ribs, and the fluid may thus be circulated in a space between the drive shaft 331 and the rotor.

Meanwhile, an additional pump part 300*a* may be further disposed in the reservoir housing 100, and connected to the second port 122.

In this way, the additional pump part 300*a* may have the same specification as that of the pump part 300 described above, and may be disposed in the reservoir housing 100 and connected to the second port 122, thereby pumping the fluid flowing out of the second port 122 through the valve part 200.

Accordingly, the fluid flowing from the reservoir housing 100 to the internal space 110 through the first port 121 may flow out to the second port 122 by driving the additional pump part 300*a* when allowed to be circulated through the valve part 200, and flow out to the third port 123 by driving the pump part 300.

Figure 5:
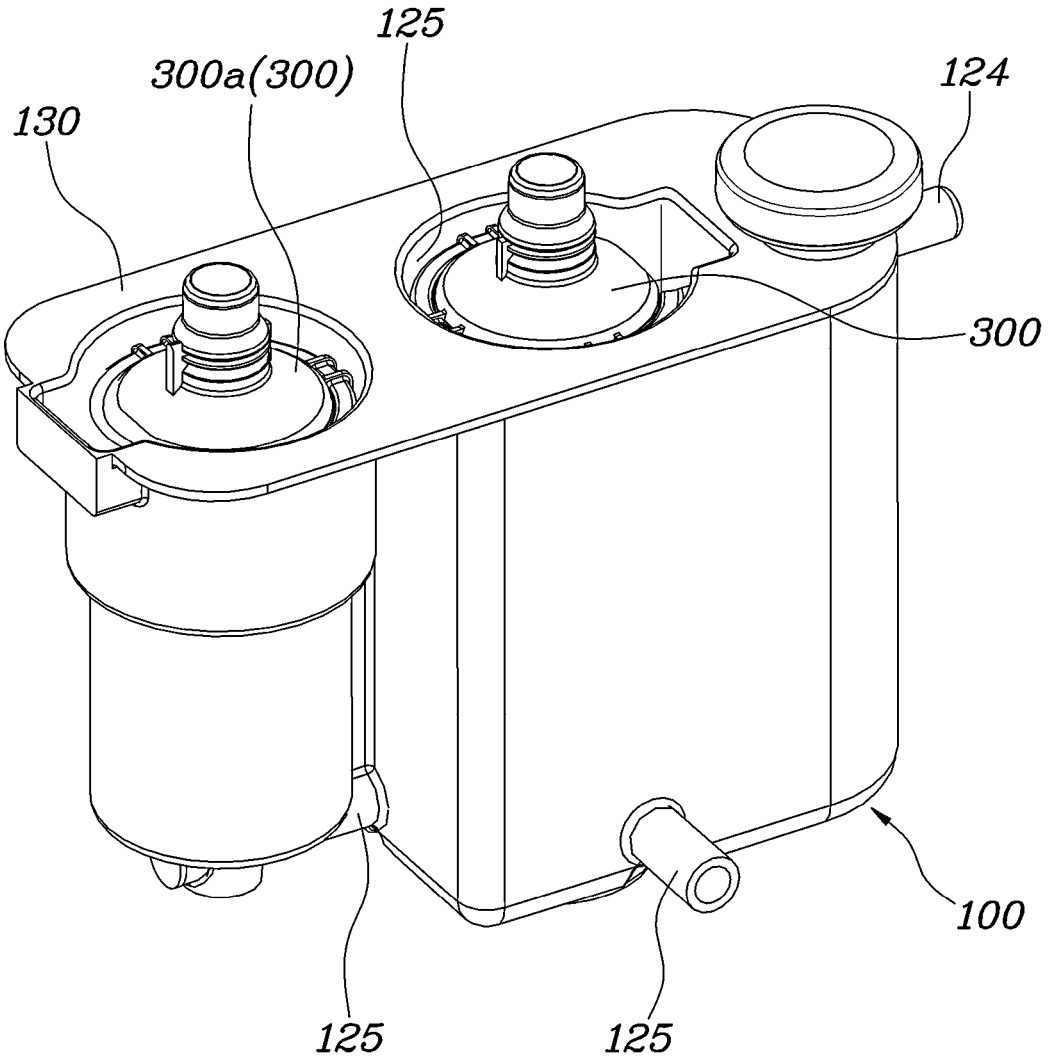
FIG. 5 is a diagram showing a fluid circulating apparatus according to another embodiment of the present disclosure.
Figure 6:
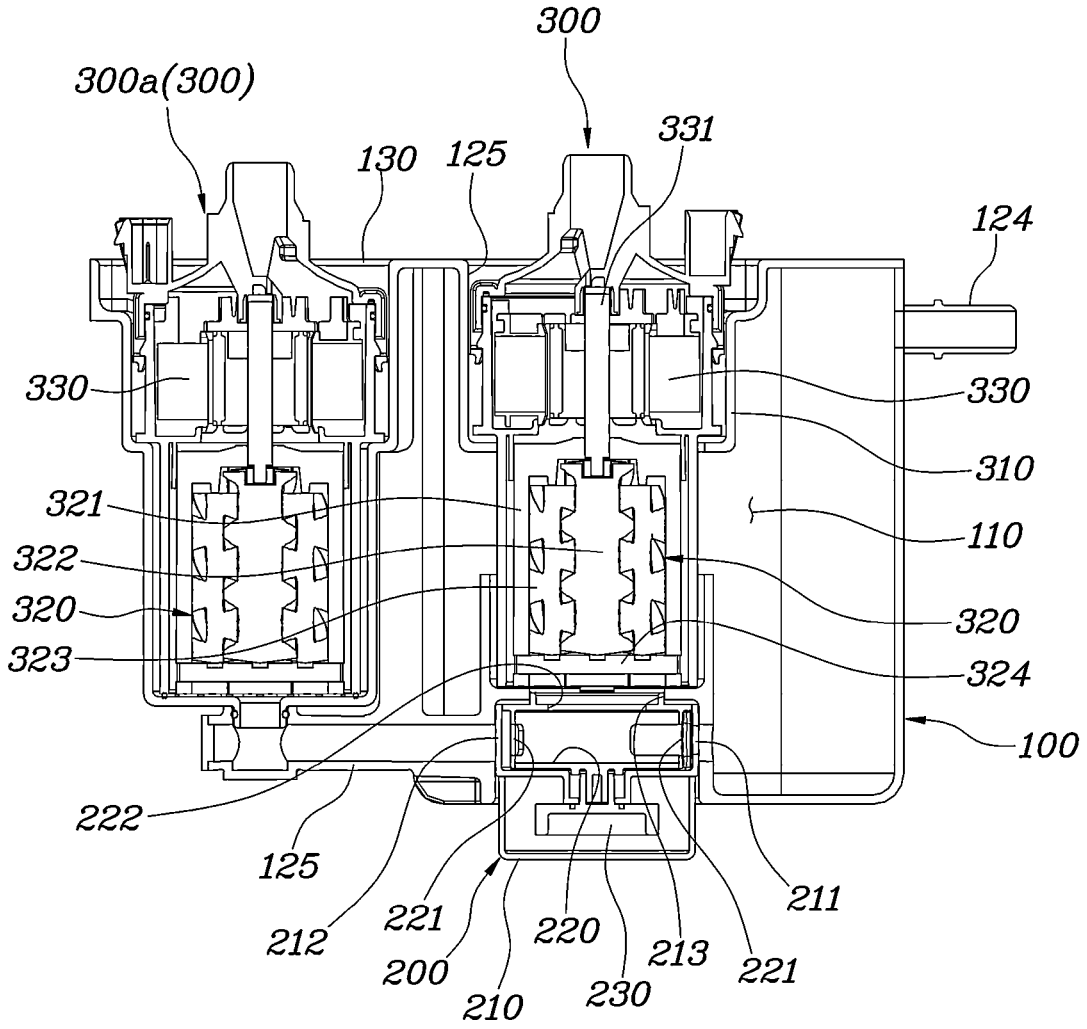
FIG. 6 is a cross-sectional view of the fluid circulating apparatus shown in FIG. 5.

Meanwhile, as shown in FIGS. 5 and 6, a fluid circulating apparatus according to another embodiment of the present disclosure may include: a reservoir housing 100 having an internal space 110 for storing a fluid and including an inlet port 124 and a plurality of outlet ports 125; a valve part 200 disposed in the reservoir housing 100 to communicate with the internal space 110 of the reservoir housing 100 and the plurality of outlet ports 125, and allowing a fluid in the internal space 110 to be circulated selectively to any one or all of the outlet ports 125; and a plurality of pump parts 300 connected to each of the outlet ports 125 of the reservoir housing 100 by the medium of the valve part 200 and pumping the fluid passed through the valve part 200.

That is, the plurality of outlet ports 125 may be disposed in the reservoir housing 100, each of the outlet ports 125 may be selectively allowed to circulate the fluid by the valve part 200 to thus allow the fluid to be circulated, and the pump part 300 may be disposed at the outlet port 125. Accordingly, the fluid may be pumped and circulated smoothly. In particular, one of the plurality of pump parts 300 may be disposed in the reservoir housing 100 to thus reduce a space for installation of the pump part 300, thereby reducing their overall size.

In detail, one of the plurality of pump parts 300 may be disposed in the reservoir housing 100 and above the valve part 200 to be connected to the outlet port 125, and the other pump part 300 may be disposed outside the reservoir housing 100 to be connected to the outlet port 125.

That is, the inlet port 124 of the reservoir housing 100 may be a passage through which the fluid flows into the internal space 110, and may be disposed on an upper side of the reservoir housing 100, and some of the outlet ports 125 may be passages through which the fluid flows out of the internal space 110, and may be disposed on a lower side of the reservoir housing 100. In addition, one of the outlet ports 125 may be open upward from the top of the reservoir housing 100, and the pump part 300 may thus be disposed in the reservoir housing 100.

In this way, the pump parts 300 may respectively be disposed inside and outside the reservoir housing 100 to thus efficiently dispose the plurality of pump parts 300 in the reservoir housing 100, thereby reducing the size of an entire package.

As described above, the plurality of outlet ports 125 may be disposed in the reservoir housing 100, and the pump part 300 may be disposed at each of the outlet ports 125. As a result, the fluid flowing in through the inlet port 124 may be pumped and flow out smoothly by driving the pump part 300 disposed at each of the outlet ports 125.

Meanwhile, a mounting part 130, on which the external pump part 300 is mounted, may be disposed outside the reservoir housing 100, thus allowing the pump part 300 disposed outside the reservoir housing 100 to be connected to the outlet port 125 while mounted on the mounting part 130.

The mounting part 130 of the reservoir housing 100 may surround the pump part 300 disposed outside the reservoir housing 100, and the mounting part 130 may be integrated with a cover of the reservoir housing 100 for the management convenience.

Accordingly, the pump part 300 disposed outside the reservoir housing 100 may be firmly fixed to the reservoir housing 100 by the medium of the mounting part 130 to thus stabilize its connection with the outlet port 125, and form one package by being integrated with the reservoir housing 100.

As set forth above, in the fluid circulating apparatus including the structure described above, the reservoir, the valve part, and the pump part are integrated with one another, and the valve part and the pump part are disposed in the reservoir to thus achieve the compact structure, thereby achieving the reduced overall size and stabilizing the fluid circulation when pumping the fluid through the plurality of flow paths.

Although the present disclosure is shown and described with respect to the specific embodiment, it is apparent to those skilled in the art that the present disclosure may be variously modified and altered without departing from the spirit and scope of the present disclosure as defined by the following claims.

What is claimed is:

1. A fluid circulating apparatus comprising:

a reservoir housing having an internal space for storing a fluid and including a plurality of ports;

a valve part communicating with the internal space of the reservoir housing and some ports, and allowing the fluid in the internal space to be circulated selectively to some or all of the ports; and a pump part disposed in the reservoir housing to be connected to the valve part, and pumping the fluid passed through the valve part, wherein the ports of the reservoir housing include a first port, a second port, and a third port, the first port is disposed on an upper side of the reservoir housing, the second port is disposed on a lower side of the reservoir housing, and the third port is open upward from a top of the reservoir housing, wherein the valve part includes a valve housing, a valve, and an actuator, the valve housing includes a first passage opened to the internal space, a second passage opened to the second port, and a third passage opened to the third port, and a rotation position of the valve is determined based on whether the actuator is operated, and each passage is thus opened and closed selectively, wherein the valve includes a plurality of first through holes disposed in an outer surface and a first through hole matching the first passage is always open to the first passage regardless of the rotation position of the valve, and a first through hole matching the second passage selectively opens and closes the second passage depending on the rotation position of the valve, and a second through hole disposed in an upper surface and constantly communicating with the third passage, and wherein the pump part is disposed above the valve housing, and communicates with the third port of the reservoir housing and the third passage of the valve housing.

2. The apparatus of claim 1, wherein the valve housing is disposed on a bottom surface of the reservoir housing, and has a portion passing through the bottom surface of the reservoir housing and exposed to the outside, thus allowing the valve to be disposed in the internal space, and the actuator to be disposed outside the reservoir housing.

3. The apparatus of claim 1, wherein each first through hole of the valve extends by a certain length along an outer peripheral surface of the valve.

4. The apparatus of claim 1, wherein the pump part includes a pump housing, a screw part, and a motor, the pump housing is installed in the reservoir housing, and communicates with the third port of the reservoir housing and the third passage of the valve housing, the screw part and the motor are disposed in the pump housing, and the screw part pumps the fluid by rotating the motor.

5. The apparatus of claim 4, wherein the screw part includes a screw housing, and a main screw, an auxiliary screw and a thrust key, disposed in the screw housing, the main screw is rotated by being connected to the motor, the auxiliary screw is rotated by being engaged with the main screw, and the main screw and the auxiliary screw are rotatably connected to each other by a medium of the thrust key.

6. The apparatus of claim 1, wherein an additional pump part is further disposed in the reservoir housing, and connected to the second port.

7. The apparatus of claim 1, wherein a mounting part, on which an additional pump part is mounted, is disposed outside the reservoir housing, thus allowing the additional pump part disposed outside the reservoir housing to be connected to the second port while mounted on the mounting part.

* * * * *